United States Patent [19]

Sacchetti

[11] 4,075,958

[45] Feb. 28, 1978

[54] SEWING MACHINE AUTOMATIC THREAD CHANGER

[76] Inventor: Alfred D. Sacchetti, 1903 Sharon Road, Meadowbrook, Pa. 19046

[21] Appl. No.: 709,697

[22] Filed: Jul. 29, 1976

Related U.S. Application Data

[63] Continuation-in-part of Ser. No. 639,569, Dec. 10, 1975, Pat. No. 4,036,157.

[51] Int. Cl.[2] ..... D05B 1/08

[52] U.S. Cl. ..... 112/163

[58] Field of Search ..... 112/163, 167, 79 R, 112/79 A, 121.11, 98, 101, 115

[56] References Cited

U.S. PATENT DOCUMENTS

| | | | |
|---|---|---|---|
| 2,556,068 | 6/1951 | Crawford | 112/79 R |
| 2,832,301 | 4/1958 | Wear | 112/79 R |
| 3,247,814 | 4/1966 | Polevitzky | 112/79 A |

*Primary Examiner*—Werner H. Schroeder
*Assistant Examiner*—Moshe I. Cohen
*Attorney, Agent, or Firm*—Caesar, Rivise, Bernstein & Cohen, Ltd.

[57] ABSTRACT

A sewing machine automatic thread changer including means to move a plurality of threaded needles, one by one, into operative connection with a sewing machine's needle bar. The threaded needles are each secured to a particular needle holder that will be urged into operative connection with the sewing machine's needle bar assembly by the action of sliding the holder in accordance with movement of a travelling carriage. Each needle holder carries a different color thread such that the color of the thread is automatically changed by appropriate travel of the carriage to position the particular needle holder into operative connection with the common needle bar assembly. A cam is provided to cause the needle holder to pivot the needles not being used to a position that is clear of the operator while the needle holder that is being used will be pivoted downwardly under the action of the cam, such that the particular needle holder will be in position to slide or move into the needle bar assembly. A thread release and guide is also provided which will exert a tight clamping action on each thread to hold the thread immobile while the carriage is moving and then release the thread when the movement of the carriage ceases. In the first embodiment of the invention, the carriage travels back and forth under the driving force of a stepping motor as actuated by a switch or series of switches.

In another embodiment a needle holder is released from a shot pin and another needle holder is advanced into operative connection therewith.

9 Claims, 15 Drawing Figures

SEWING MACHINE AUTOMATIC THREAD CHANGER

The application is a continuation in part based on prior filed application Ser. No. 639,569 filed Dec. 10, 1975 and entitled Automatic Thread Changer now U.S. Pat. No. 4,036,157 issued 7/19/77.

This invention relates to a sewing machine automatic thread changer and has as its objective the provision of a sewing machine automatic thread changer to replace the tedious method of changing from one thread color to another thread color on a sewing machine.

It is the present practice in changing thread color to remove a spool and rethread the machine before it is possible to sew with a different thread. Such practice is tedious and time consuming and also causes operator fatigue.

It is accordingly an object of the invention to provide an automatic thread changer which eliminates the tedious steps connected with changing of thread in a sewing machine.

It is a further object of the present invention to provide an automatic thread changer which can effect the introduction of a needle having a different color of thread associated therewith in a small fraction of time necessary to change thread on an existing needle;

Yet another object of the present invention is to provide an automatic thread changer which can be marketed at a reasonably low cost which will accomplish substantial time savings in essentially eliminating the time necessary for rethreading.

The foregoing, as well as other objects of the invention are provided by the automatic thread changer of the present invention wherein the travelling carriage advances a desired needle holder into operative connection with the needle bar assembly. In the specific embodiments disclosed herein, the automatic thread changer will carry four needle holders, thereby enabling a single machine to sew these four different color threads, although it is clear that a larger or smaller number of needle holders can be employed. The present invention further includes a movable carriage operated by a stepping motor such that a particular needle holder can be advanced into operative connection with the needle bar assembly by switching means.

Other objects of the invention will become more readily apparent by reference to the accompanying drawings wherein.

Figure 1:
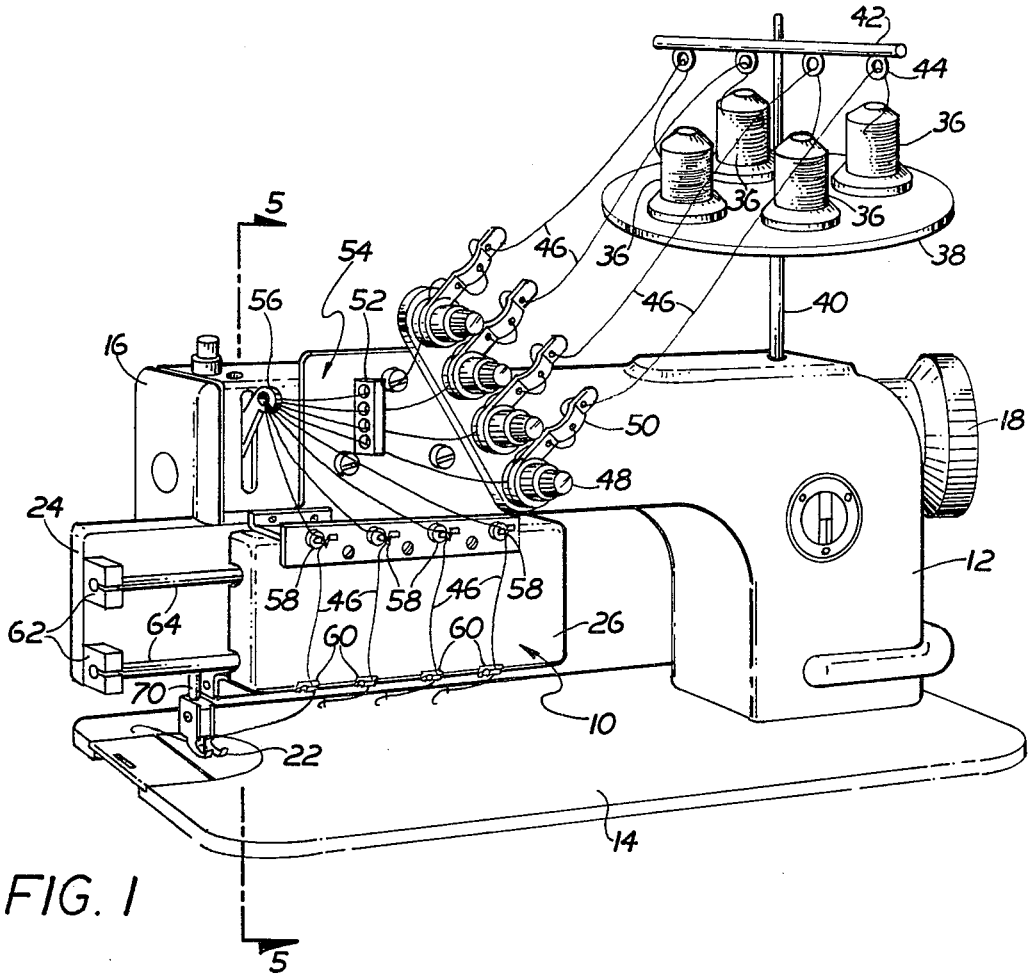
FIG. 1 is a three-dimensional view showing a first embodiment of the automatic thread changer of this invention mounted into operative connection with a sewing machine.

Referring now to the various figures of the drawings wherein like reference characters refer to like parts, there is shown at 10 in FIG. 1 a first embodiment of an automatic thread changer which is secured to a conventional sewing machine 12, details of construction of which are well-known to those skilled in the art.

The sewing machine 12 is of constructional convention and includes base 14, sewing machine head 16, sewing machine wheel 18, needle bar assembly 20 and presser foot 22.

It will be seen that the automatic thread changer basically comprises mounting plate 24 (FIG. 3) which receives carriage 26 for sliding movement thereon as will be discussed hereinafter.

The conventional sewing machine 12 requires only slight modification in order to receive the automatic thread changer of the present invention. This is done by removing the tensioner from hole 120, putting a notch and a detent in the needle bar assembly and drilling and tapping holes 30 (FIG. 3).

Figure 3:
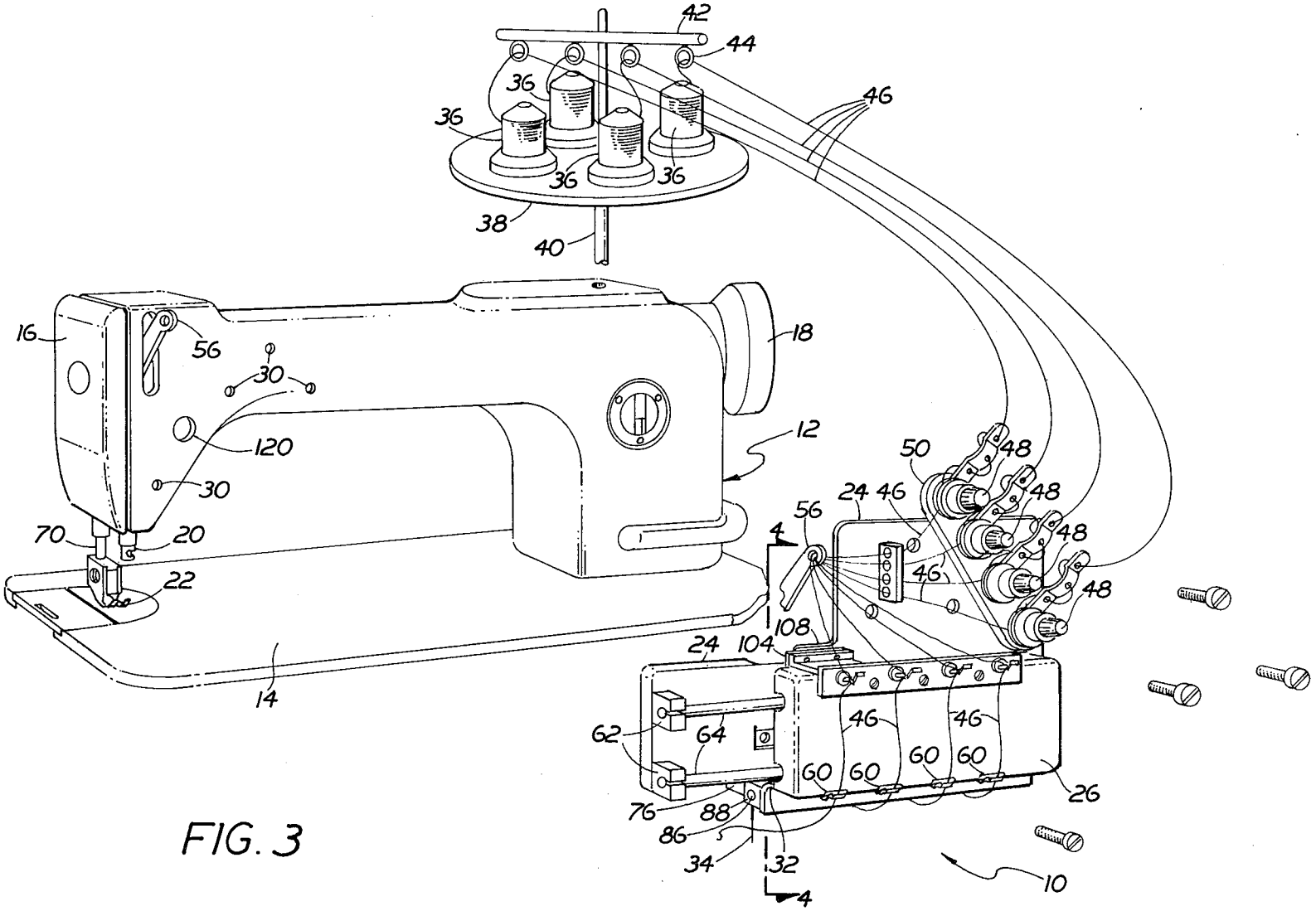
FIG. 3 is an exploded three-dimensional view of the automatic thread changer of FIG. 1.
Figure 6:
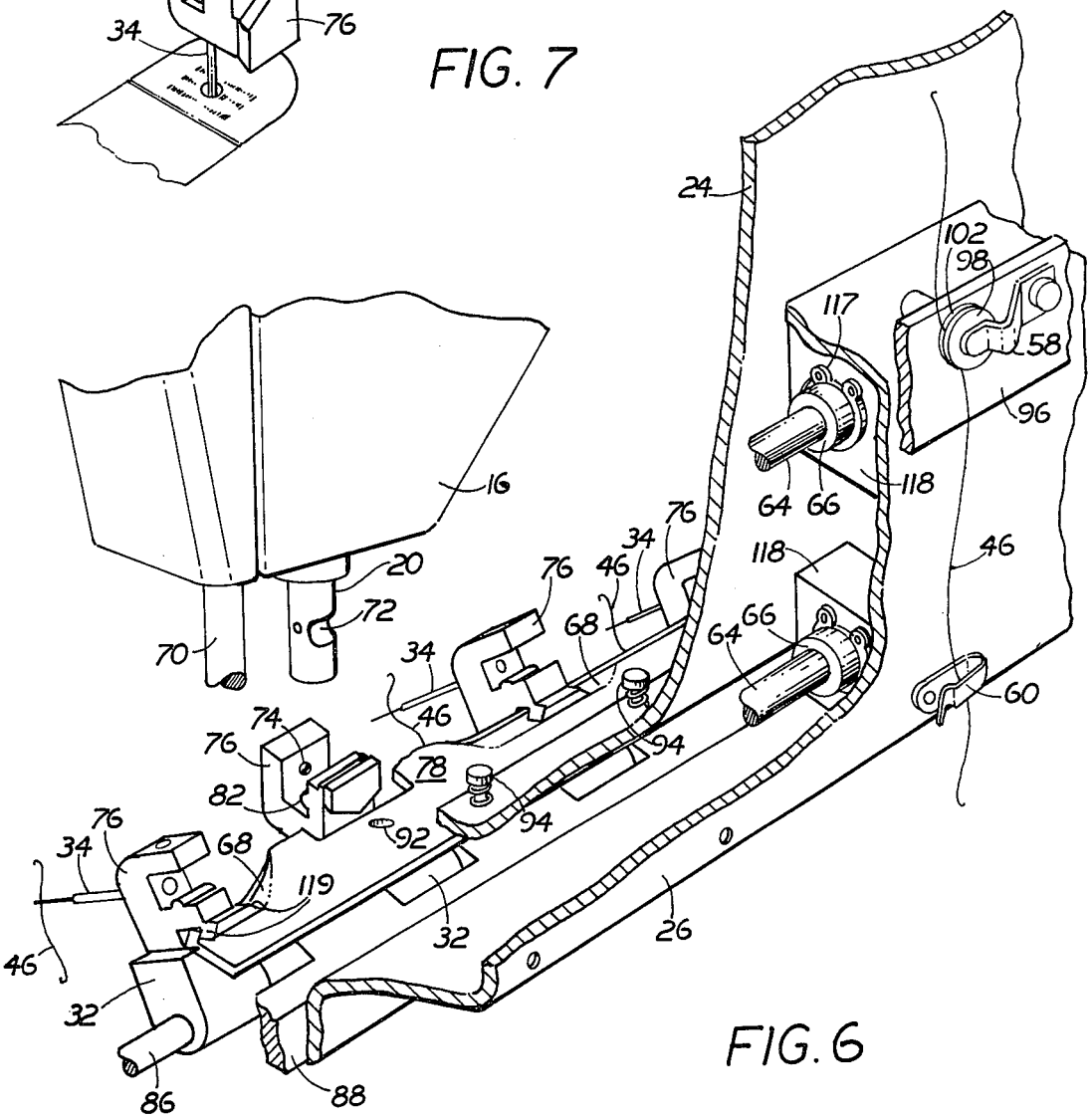
FIG. 6 is a fragmentary, enlarged, three-dimensional view taken from the opposite side of the sewing machine as compared with the direction of FIG. 1.

The details of the automatic thread changer 10 are best seen by making an initial review of FIGS. 3 and 6. The automatic changer 10 operates on the principle of providing a plurality of pivotal blocks, each of which carries a sewing needle 34, with the carriage 26 advancing a desired needle holder 76 into operative connection with the needle bar assembly. The sewing machine mechanism then operates that particular needle which has been advanced into operative connection therewith.

Each holder carries a different color thread, such that the color of the thread is automatically changed by appropriate travel of the carriage 26 to position a particular needle holder 76 into operative connection with the needle bar assembly. The action of carriage 26 will automatically snap out the particular needle holder 76 from the needle bar assembly 20, thereby allowing the next desired needle holder 76 to be advanced into operative connection with the needle bar assembly 20 by the travelling carriage 26.

Figure 7:
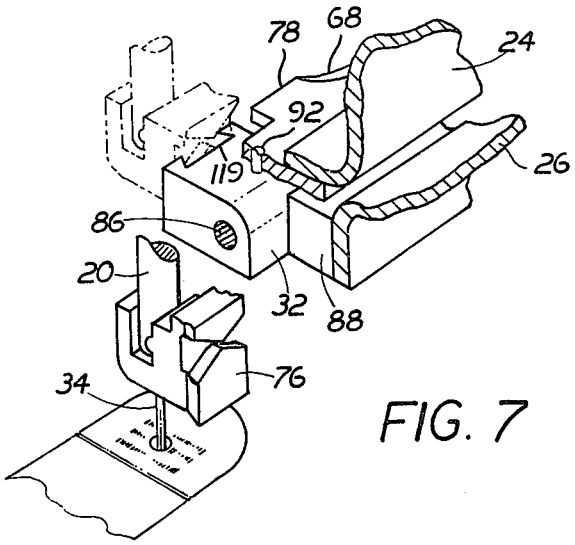
FIG. 7 is a fragmentary, enlarged, three-dimensional view showing the relationship of a needle holder, pivot block, and needle bar assembly.

Each needle holder 76 is carried in a pivot block 32 by means of a dovetail slot 119 (FIG. 7). When needle holder 76 is locked to needle bar assembly 20, it will be free to slide up and down in dovetail slot 119 of pivot block 32 which is now in a stationary position. Pivot blocks 32 are pinned to trunion block 88 which is fastened securely to carriage 26.

Reference is now made to FIG. 3 for further details of the automatic thread changer 10. The various spools of thread of different color 36 are secured in a conventional manner on a stand 38 which extends from support 40 to which is also secured an arm 42 having eyelets 44 through which the various threads 46 are guided to tensioners 48 that are secured through mounting strip 50 that extends from the mounting plate 24. The thread 46 is then led from the tensioner 48 that are secured through mounting strip 50 that extends from the mounting plate 24. The thread 46 is then led from the tensioner 48 to a thread leader that is attached to the mounting plate extension 54. The thread is then passed through the thread puller 56 of the sewing machine base 14 and then through the thread release and guide 58 (for each thread) that is attached to the carriage 26 as can be seen in FIG. 3. The thread 46 then passes through guides 60 and then to the sewing needles 34.

Figure 2:
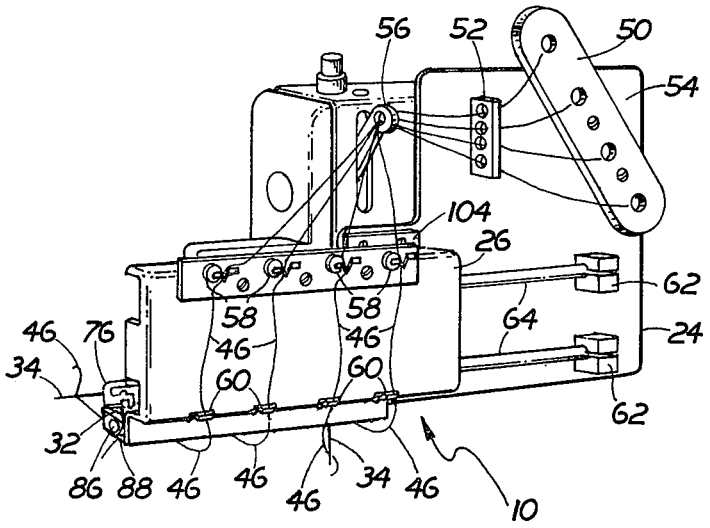
FIG. 2 is a view similar to FIG. 1, but showing only the automatic thread changer invention and with the carriage advanced to a lefthand position.
Figure 5:
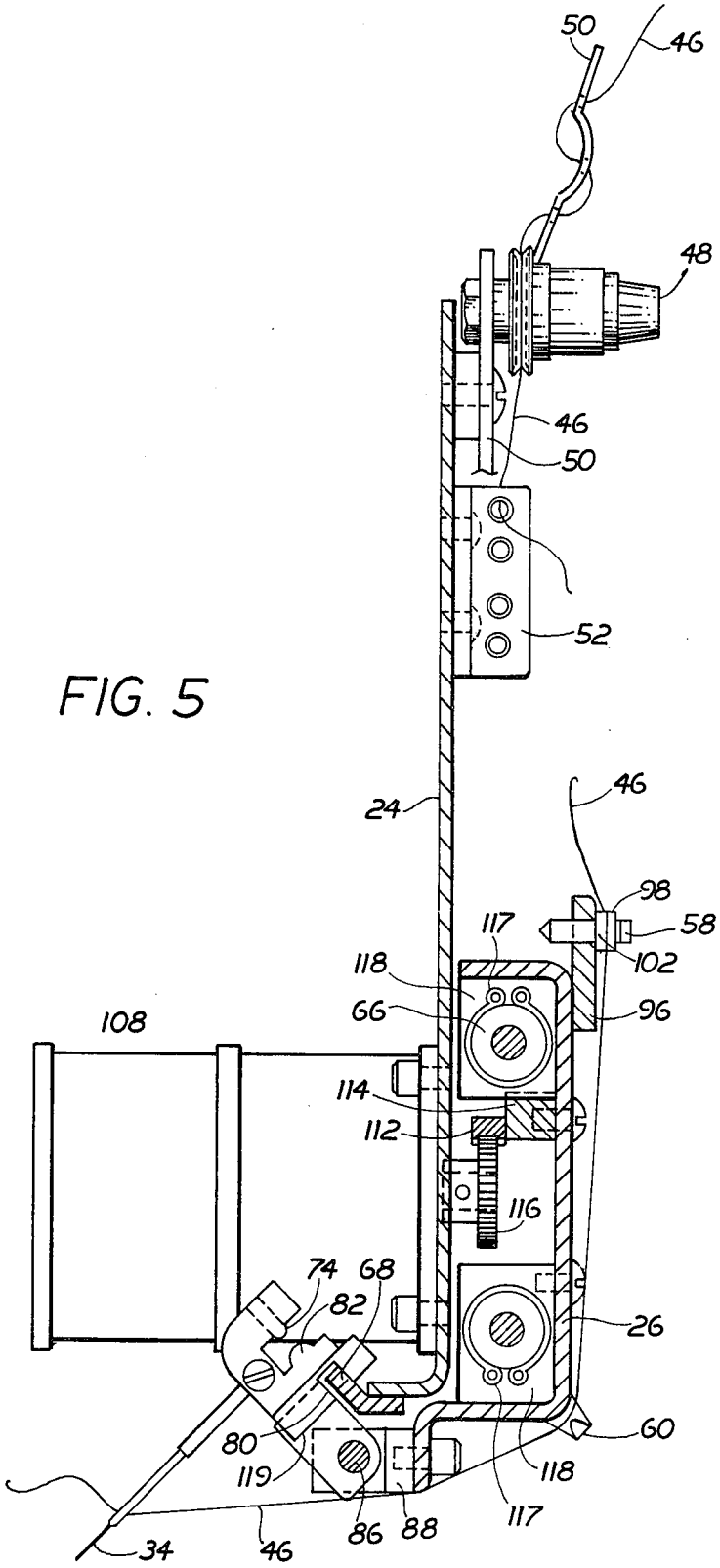
FIG. 5 is a sectional view, similar to FIG. 4, but taken further to the right as viewed in FIG. 1, and showing a needle holder and pivot block in the disengaged position.

FIGS. 1, 2 and 3 reveal that the mounting plate 24 carries rail support blocks 62 which receive and hold the stationary guide rails 64 upon which carriage 26 travels in order to position a particular needle holder 76 into operative connection with the needle bar 20. The carriage 26 possesses four ball type bushings 66 (FIG. 5). Bushings are held in place by snap rings 117. Said bushings are fitted into mounting block 118 which in turn are securely fastened to carriage 26. These bushings 66 now enable the carriage 26 to be held on to the rails 64 and to slide or travel thereon as will be discussed hereinafter. Also attached to the carriage 26 is a cam 68 whose function will be described hereinafter.

It will be appreciated that FIG. 2 differs from FIG. 1 in showing that the carriage 26 has traversed from the righthand position of FIG. 1 to the lefthand position of FIG. 2. It will be understood that in the specific embodiment of the invention shown that the carriage can traverse from right to left, or left to right and stop at any one of intermediate positions. Clearly, the automatic thread changer can be provided with a lesser or greater number of stations, depending upon the number of different colors desired.

Additional details are shown in FIG. 6, including the presser foot shaft 70 and the needle bar 20 which has notch 72 formed therein. Also shown is spring loaded ball 74 in the outer wall of needle holder 76. The ball 74 serves to hold the needle holder 76 in operative position with reference to the needle bar 20 as will be described hereinafter. Other details visible in FIG. 6 are the needle bar cam 68 and the needle holders 76 and the pivotal block 32.

It will be appreciated that the needle bar cam 68 is stationary and is a part of the mounting plate 24. The needle bar cam plate 68 possesses a track and flat area 78 and each of the needle holders 76 possesses a notch 80 such that when the carriage 26 is actuated, the notch 80 is caused to ride on the cam track 68. This action causes the needle holder and pivotal block to rotate the needles not used, clear of operator. However, the needle holder 76 that is to be used will pivot downward on to the flat area 78 so that the needle 34 lies in a vertical plane as the needle holder 76 is brought into operative connection with the needle bar 72 and projecting ledge 82. When connection is complete, needle holder 76 has now become part of needle bar assembly 20 (FIG. 7) and is free to slide up and down in dovetail slot 119 of pivotal block 32. Finally, there is also shown in FIG. 6 the thread release and guide 58 as well as one of the thread guides 60 for guidance of thread 46.

Figure 4:
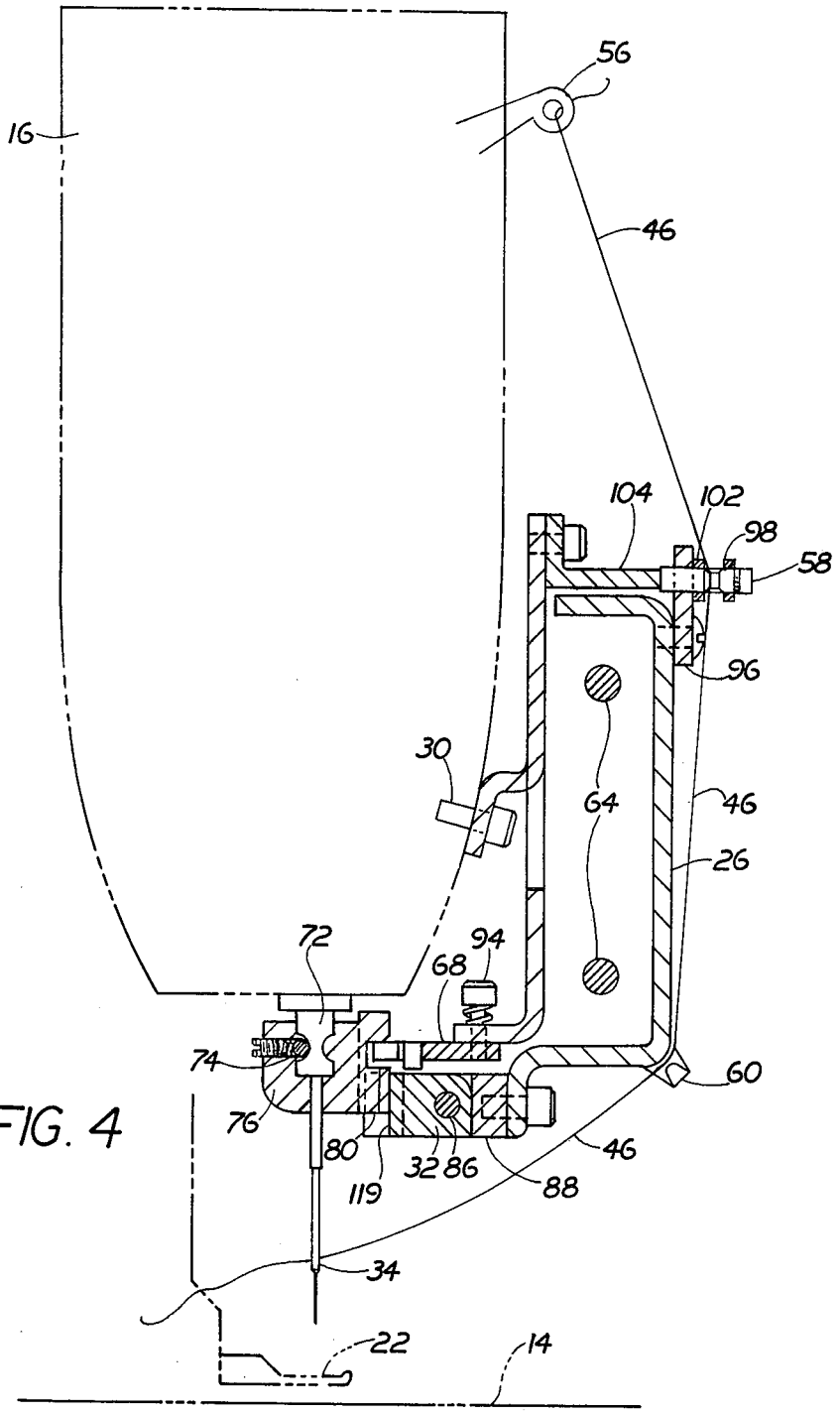
FIG. 4 is a somewhat enlarged, vertical sectional view taken through the automatic thread changer of FIG. 1 to the left of the needle bar assembly and presser foot and looking to the right as viewed in FIG. 1 in order to show certain details of the mounting plate and carriage.

Other operative details of the invention are better understood by reference to FIGS. 4 and 5. Particular attention is called to the needle bar assembly 20 which has a notch 72 therein, (configuration of this notch can vary). Also provided as a part of the needle holder 76 is a detent or spring loaded ball 74 as previously discussed. This enables the positive locking in of a particular needle holder 76.

As further shown in FIGS. 4 and 6, the various pivot blocks 32 are pivotally secured on the trunion block 88 by pin 86. Of further interest is the trunion block 88 and its fastener. This block acts as a guide and stops the pivot block 32 from flopping. The cam 68 can also be seen in FIG. 4 and it should be noted that a stop 92 is provided which acts to prevent further pivoting of a particular pivot block 32 when in an operative position. Attention is directed to spring and screw 94 which gives a floating action to the cam plate 68 for misalignment of the needle bar assembly 20 in the up position.

Certain details of the thread release and guide 58 can also be seen in FIG. 4. In particular there is the guide plate 96 through which pin 98 passes with the pin 98 having a hole to permit passage of thread 46. There is also a rubber washer 102 which helps to hold the thread 46. Upon actuation of the carriage 26, cam 104 (FIG. 4) which is fastened to mounting plate 24 strikes pin 98 as it passes the cam, thereby forcing open the leaf spring. At such time the thread release and guide 58 allows free passage of thread 46 under action of the sewing machine and conversely when pin 98 is not in use, it will pass by cam 104 and slip off and in conjunction with the rubber washer 102 it will provide a tight clamping action upon the thread 46, to hold the thread 46 immobile between clamp and needle while carriage is moving (FIG. 5).

The carriage 26 travels back and forth under the driving force of a conventional bi-directional stepping motor 108. The action of the motor 108 has the effect of driving gear 116 which in turn actuates gear rack 112 which is held by gear rack support 114 attached to carriage 26. This causes movement of the carriage 26 along guide rails 64.

The action of the stepping motor is in accordance with the wiring whereby the carriage can be moved back and forth to any one of four positions upon actuation of a button. There is a printed circuit using a pulsator to drive the bi-directional stepping motor 108 with a 0.75 inch P.D. drive gear 116 and rack 112. The stepping motor 108 will index 10 degree per impulse or 0.0654 inches. The pitch of the carriage 76 is 0.1243 or 19 impulses from pulsator. The stepping motor 108 is rated at 15 impulses per second or 1.22 seconds to move from station to station. Stated another way, the solid state control system involves printed circuitry such that the pulser tells the bi-directional stepping motor 108 how many steps to take. Alternatively, the motor can be eliminated and the carriage 26 slid by hand from position to position.

In conclusion, the automatic changer of this invention moves a plurality of threaded needles to and from a sewing machine needle bar and operatively connects the sewing needle to the needle bar assembly. The thread in the needle can vary in color, material and thickness. Also, the needle sizes can vary accordingly. In this fashion, the tedious method of changing from one color to another; namely, removing the spool, rethreading the machine and needle can be avoided, thus eliminating down time. With this invention, an operator can at a glace see the next color of the garment to be sewn, press the proper button and within 1.22 seconds a new needle and color is presented. In this fashion, the operator does not lose the all important rhythm and time required fumbling, looking for the new color spool and rethreading.

The invention can also be used where presently a plurality of sewing machines are used in a line. In this instance, depending on how the machine is driven, (computer, tape, etc.), an interface of the computer's supplied or of set buttons for those not driven by computer. In every event, the system is the same; that is when a signal is received that a new color is required, a button is pressed or a relay is tripped and all machines will then change colors simultaneously in 1.22 seconds. Time saved in this case: — example, a 12 head embroidery machine — time required to change color 30 to 60 seconds. In 30 seconds — 12 × 30 seconds = 6 minutes, 6 minutes × number of colors, 4 = that makes 24 minutes of changer over time. This invention will change 4 colors in 7.32 seconds.

This invention can also be used on machines that use double needle bars or holder. Instead of transferring one needle, we can move two or more needles into position.

This automatic changer principle can be incorporated into the original manufacturing of a sewing machine so that it becomes an integral part of the machine. It will be clear that needle positioners and thread trimmers will be incorporated as necessary.

The present invention is made from typical steel or other metals, although plastic can be substituted in whole or in part by casting, molding and other techniques.

Attention is now called to FIGS. 8 to 13 which show another embodiment of the invention.

Figure 13:
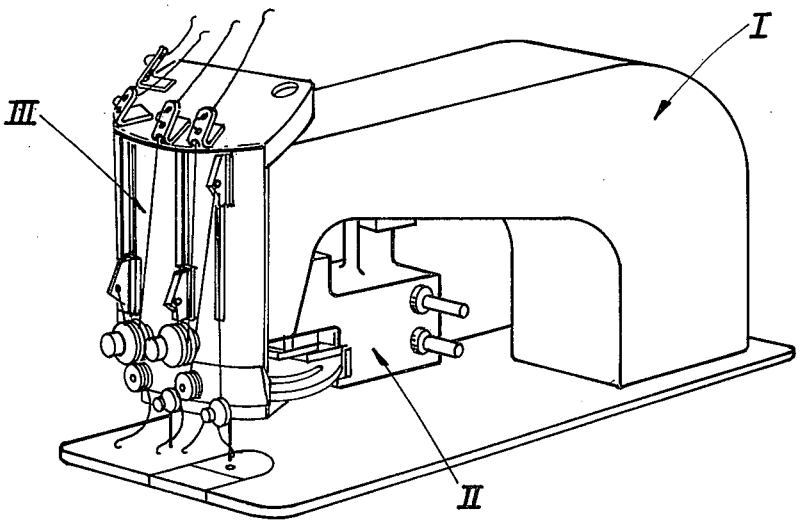
FIG. 13 is a three-dimensional view showing the second embodiment of the thread changer secured in operative relationship to the sewing machine.

FIG. 13 shows an assembly view of a standard sewing machine head, used in the embroidery art. Reference No. I is to a standard sewing machine; reference No. II shows the oscilating arm and gear box drive and reference No. III shows the thread slides and tensioners. While, the drive unit for the gear box is not shown, it will consist of two drive shafts. One is a 90° geneva drive. The other shaft will turn 360°. These shafts are powered by a standard motor and a solid state memory system that will interface with a computer. This drive system will operate one or more units.

Figure 8A:
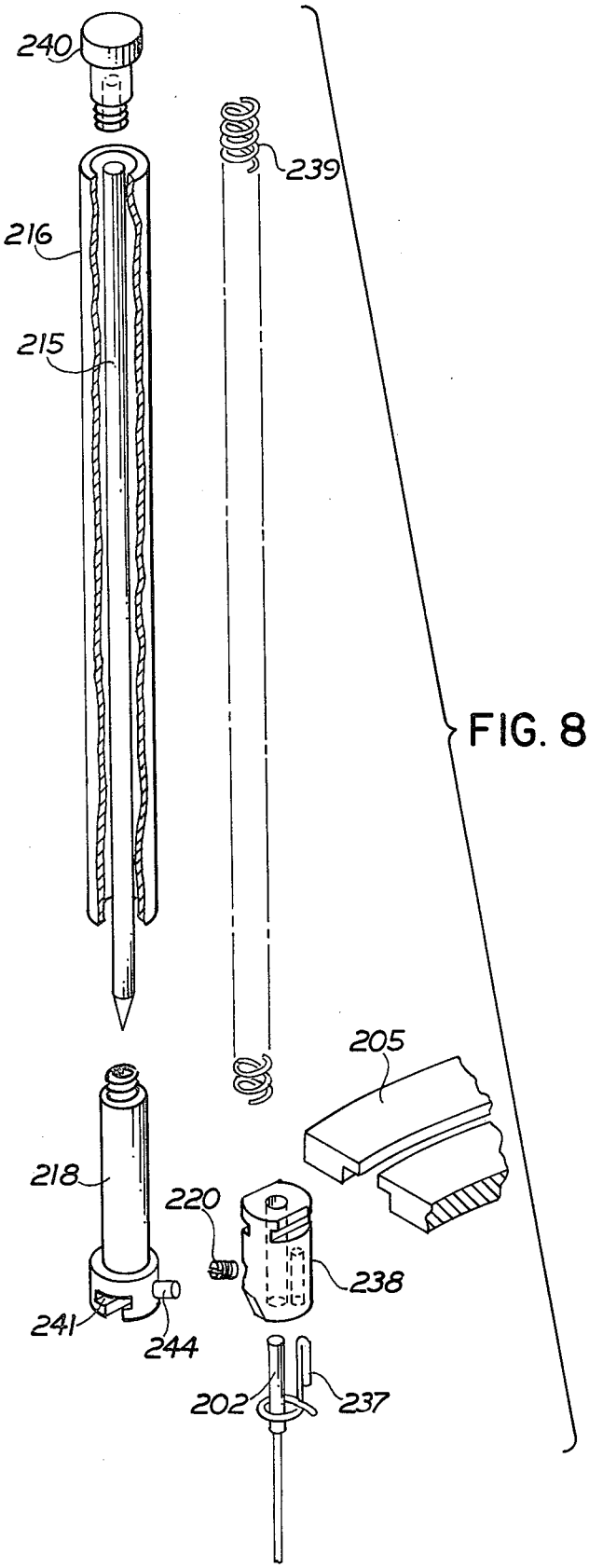
FIG. 8A is a three-dimensional view broken away in part, showing a second embodiment of a part of the invention.
Figure 8B:
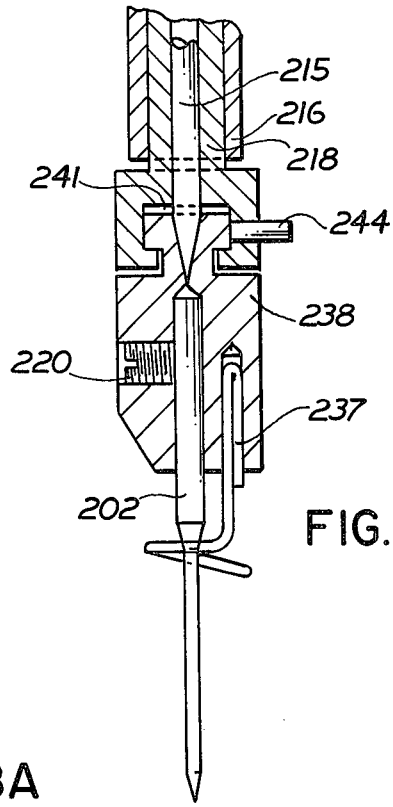
FIG. 8B is a sectional view showing features of FIG. 8A.
Figure 8C:
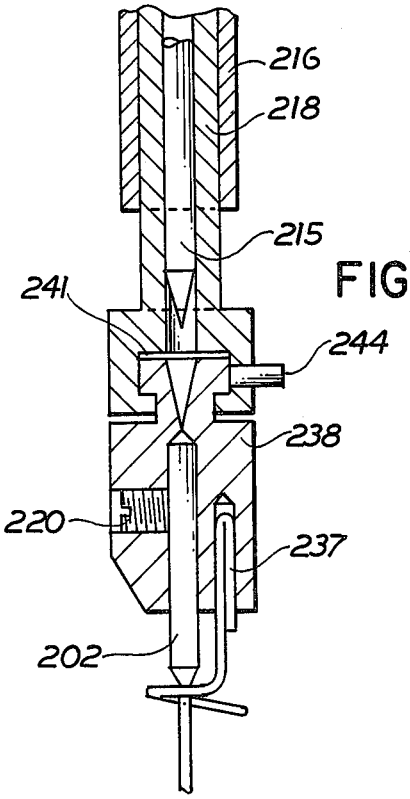
FIG. 8C is a view similar to FIG. 8B, but showing a different position of the common needle bar.
Figure 9:
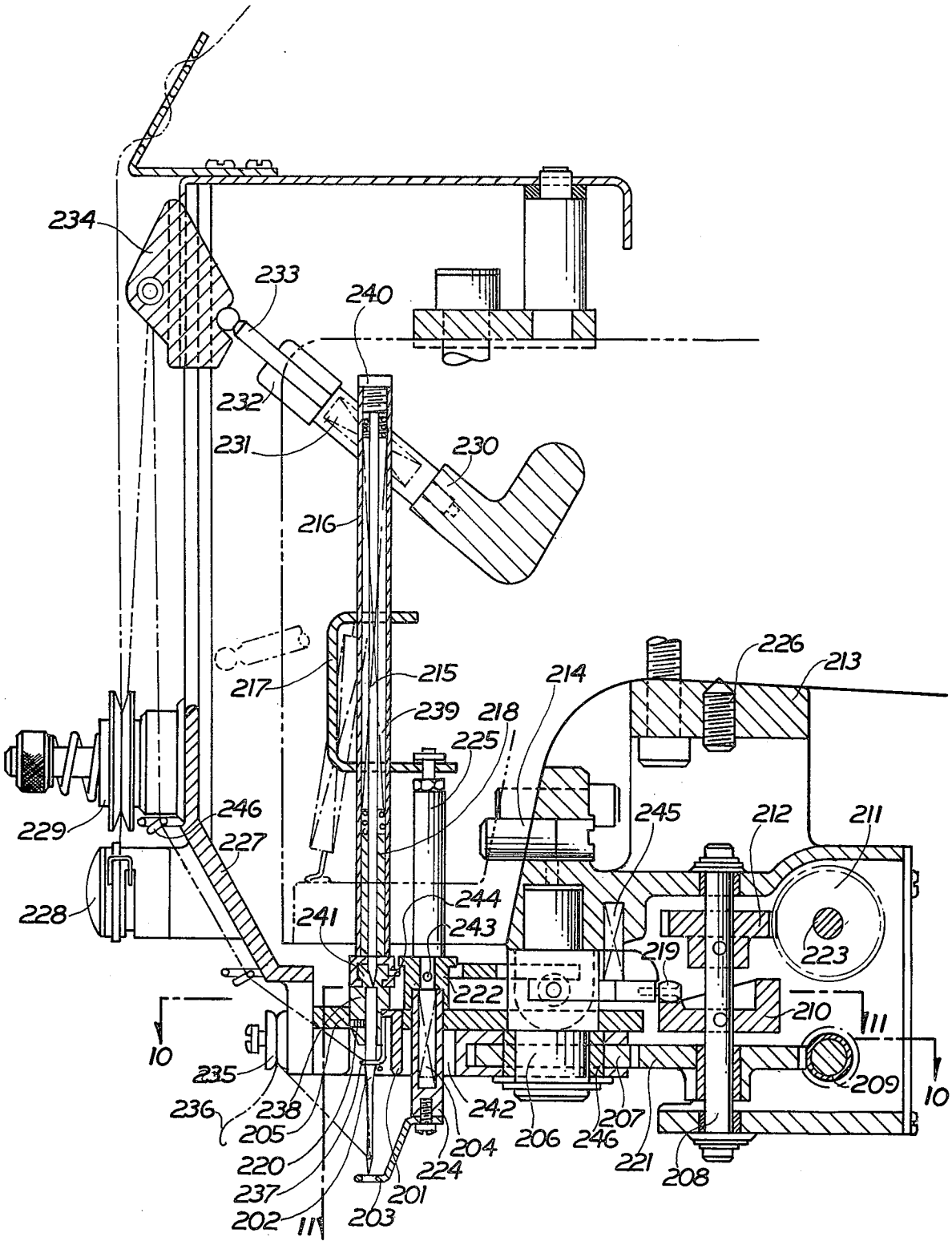
FIG. 9 is a sectional view through the entire thread changer constituting the second embodiment of the invention.
Figure 10:
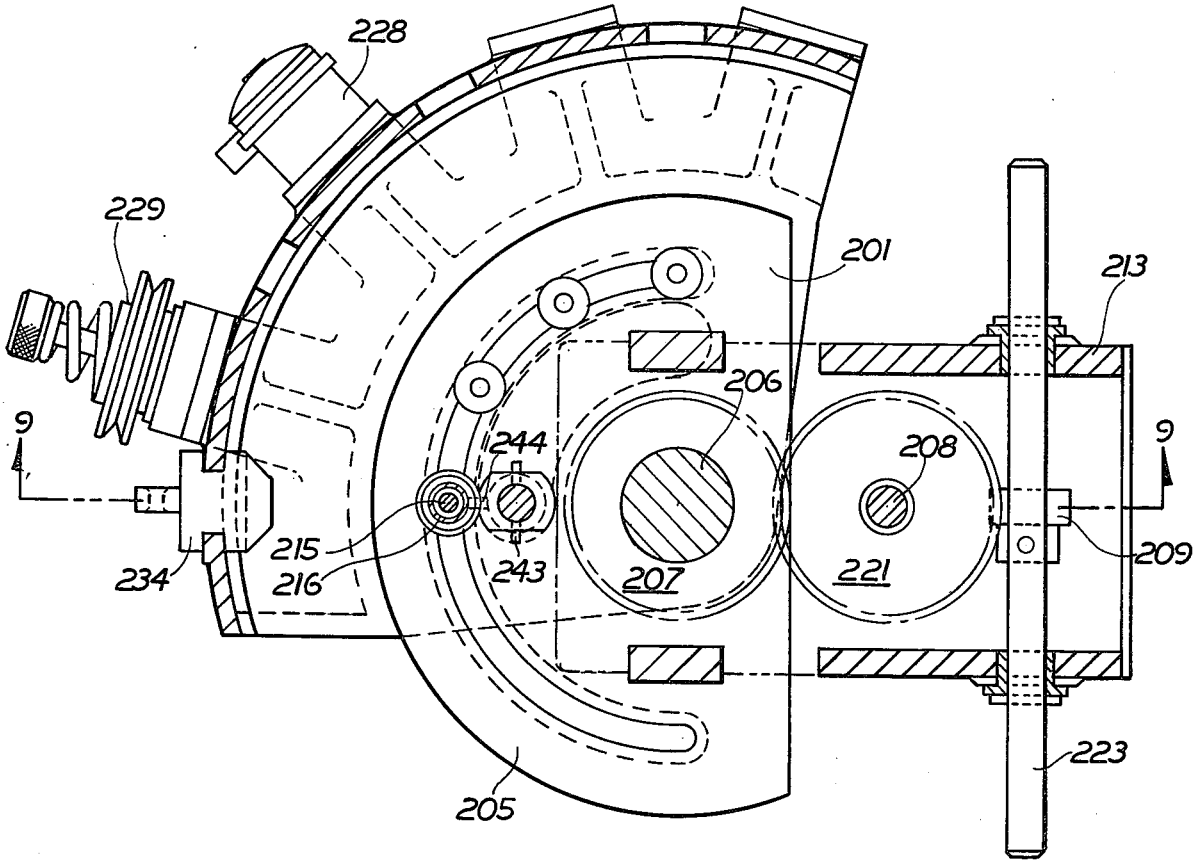
FIG. 10 is a sectional view taken along the lines of 10—10 of FIG. 9.
Figure 11:
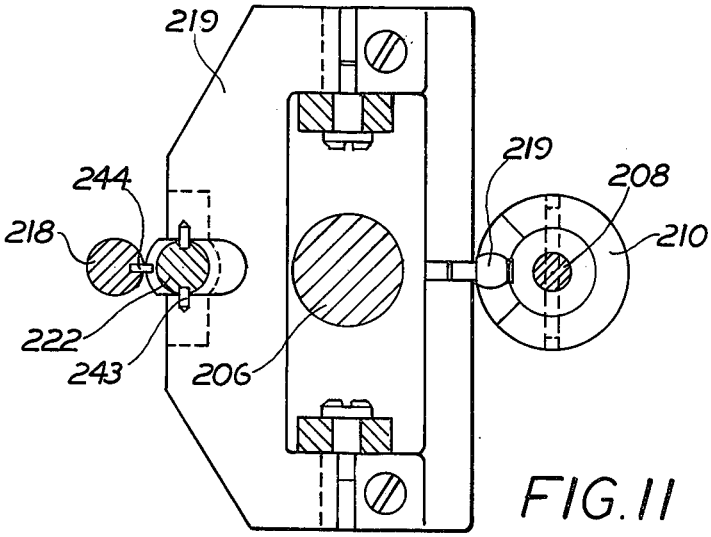
FIG. 11 is a sectional view taken along the lines of 11—11 of FIG. 9.
Figure 12:
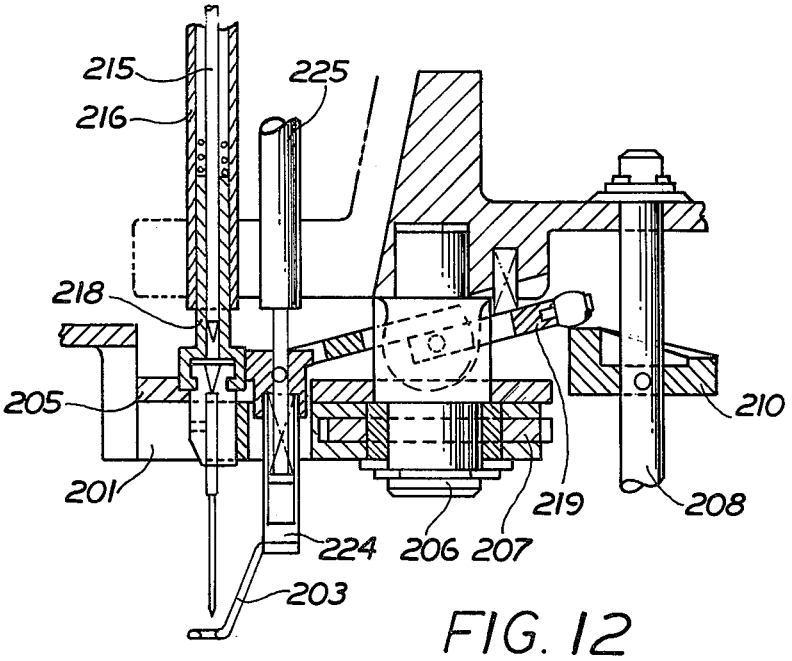
FIG. 12 is sectional view showing the camming elements in relation to a shot pin assembly.

FIG. 9 shows a section through gear box (Nos. I & III in FIG. 13). There is an assembly of oscillating arm 201, the solid needle bar and gear box casting 213. The solid needle bar assembly (FIG. 8) consists of a ground tube 216, a shot pin 215, tension spring 239, a sliding connector 218 having a female "T" slot 241, and cap 240. Shot pin 215 is press fit in cap 240; a tension spring 239 is threaded on to the cap 240 together forcing shot pin 215 to protrude through the "T" slot 241.

The needle holder 238 has a thread bale 237 and set screw 220. Needle 202 is firmly held in place by the set screw 220, (FIG. 8) with thread bale 237 being forced into a slot (FIGS. 8 & 9). The needle holder 238 has a "T" projection, with a tapered hole drilled into the top of 238 to allow shot pin 215 to enter. Shot pin 215 will lock needle holder 238 in place and an up spring pressure is applied to slide connector 218 and a pull down pressure on cap 240 will tend to exert pressure on shot pin 215 thereby creating in effect a solid needle bar assembly of FIG. 8.

The next assembly is the gear box 213 shown in FIG. 9 (No. III.). This assembly will comprise of (See FIG. 12) a post 206, needle holder carrier 205 activating pivot ring 219, (FIG. 12) arm 201, arm gear 207, idle gear for arm 221 (FIG. 9) pinion drive gear 209, drive shaft 223 (FIG. 10), activating cam 210, cam drive gear 212, cam pinion drive gear 211 and shaft 208.

Having devised means for attaching a threaded needle holder to a common needle bar 215, the holders are to be carried from station to station and back again. This will be done by having (4) holes or berths in arm 201. See plan view FIG. 10 where the berths are numbered 1, 2, 3 and 4. These will represent the four color changes. These holes will be opened on the outside edge to allow free passage of thread.

A radial slot 242 (FIG. 9) will be cut in the arm 201 to clear the presser foot assembly. The arm 201 will have a slot milled in it to receive gear 207, and bronze bushing 246 (FIG. 9) will be press fit in arm 201 and gear 207. Gear 221 is secured with screws.

The needle holder carrier has a radial "T" slot that will conform to the same as radius needle holder 238. The slot will fit "T" slots of holders thereby supporting them from falling when not in use. A hole at a needle bar location will have a clearance in it to clear sliding connector 218 thereby allowing a threaded needle to operate freely.

The foregoing covers the interlocking of the shot pin 215 and needle holder 238. Next to be discussed is the method of releasing the needle holder from sliding connectors (See FIG. 12). This is accomplished by the activating pivot ring 219. The ring will be raised and lowered by means of a cam 210. This cam is pinned to shaft 208, which also has a drive gear 212 pinned to it. This assembly is driven by a pinion 211 and will revolve 360° per index. Cam 210 is turned and will lift ring 219 causing it to contact pins 243 at sides of cap 222. This will depress presser foot 203. The cap 222 has a lip which will contact pin 244 on sliding connector 218. In this manner both pressure foot 203 and the slide connector will be carried downwardly. This motion will free needle holder 238 from shot pin 215 and also bring it in line with the needle holder ring 205 slot. Thus, there is one index of arm 201 which is driven by gears 207 and idle gear 221 which is free wheeling on shaft 208. Gear 221 is turned by pinion 209 which is pinned to shaft 123. This shaft turns arm 201 30° per index causing holder 238 to disengage from the slide connector 218 and slide onto the ring support 205. Of course, as the arm continues to turn, a new needle holder 238 is brought into operation with the slide connector 218. While all this is happening, the presser foot has also moved down to allow clearance for the outgoing and incoming needle.

On this particular sewing machine, which is used in the embroidery art, it will have a spring loaded presser foot 217. This foot will come down with every stroke of the machine. The foot will precede the needle at entrance and on the up stroke the foot 203 and is the last to leave the material. The foot is contructed by utilizing a sheet steel "V" section 217 which has the needle bar pass through it. Also fastened is a spindle. This spindle has a neck with a spring 204 clipped to it. Around this spring is a tube 224 which has a lipped cap 222 screwed to it. This lip 222 rests on pin 244 in the up position. Fastened to the bottom of this assembly is the foot 203 which has a hole at the bottom for needle 202 to pass through. This complete assembly will operate as one unit on up or down stroke. However, as mentioned, the lower position is spring loaded in the up position so that at the proper time it can be lowered to allow clearance for needle to pass though.

Putting it all together, a typical sequence of operations shall consist of, first a signal from the master control, computer manually operated signal. This signal will start the machines. When the program calls for a thread change, the control will signal the machine to stop and activate the thread changer drive system. First, the pinion 211 will turn gear 212 which is pinned to shaft 208. Cam 210 will lift pivot ring 219 which will lower opposite end. This action will release needle holder 238 from shot pin 215. It will also line up "T" slot of holder 218 with support ring 205. The cam 210 will now go into a dwell state keeping the needle holder 238 in the down position. While this area is held, the pinion 211 will only rotate 90°/index, thereby turning gear train 221 and 207 and turn arm 201 30°. This action of turning will remove holder 238 from connector 218 and place the holder into the support ring 205. At the same time, arm 201 will carry the next holder into the connect position. When this point is reached, the pinion gear 209 stops and goes into dwell. In the meantime, cam 210 comes off its dwell and returns pivot ring 219 to its proper position. This action is aided by a compression spring 245. With the pressure released, presser foot returns to normal, thereby allowing connector 218 to return home. This action will cause shot pin 215 to enter into holder 238 and lock it firmly in position to form a solid needle bar assembly. When this cycle is complete, it will signal a fail safe switch that is hooked in series with the other changers. When all switches are made, the master control is activated to start the sewing machine again.

In FIG. 13, #III is the thread tensioning and the thread take up unit. The main body of this unit is the support casting 227. The shape will conform with the radial face of the arm 201 and it will be secured there by means of screws. Each thread position will have its own tensioner 229, thread break switch 228 and take up slide 201. Tensioners are the standard roller type. The thread break switch 228 is one made by Gross Embroidery Co. of Philadelphia, Pa. The take up slide 234 is made of Delrin plastic with a carbide insert in the thread passage hole. The mode of operation involves passing the thread around tensioner 229 wheel and wrapped under thread break spring. The thread will continue up and through thread passage hole in take up slide 234. The thread will continue down through thread guide 246 and through thread bale on holder 238 and eventually through eye in needle allowing approximately 5 inches of thread 236 to be snapped through spring clip 235. All stations are loaded thus.

Next, there is the sewing machine take up arm 230, 231, 232 and this arm will be modified to accept a spring plunger nose 233. This nose end will connect with a notch on the thread take up slides 234 inside surface, since we have a common take up arm on the sewing machine proper. It will be necessary to move the take up slides 234 into a connect position. Since the stopping location of the arm 230, of the sewing machine is unpredictable, it was feasible to let the slides form the firm connect point and have the take up arm stop wherever it wants. Since the notch on the slide 234 is open at sides, we can disengage nose end 233 of take up arm 230, 231, 232 by rotating either direction. When slide is released, it will drop to low point of the slot. Take up slide 234 in turn is free of any connection. When index is complete, a new slide will have presented itself resting on the bottom of the slot. Now as sewing machine starts up, take up arm 230 will first swing up reaching its peak. It will descend and make contact with entrance angle on inside of slide 234 face. This angle will depress nose 233 and lead it to a notch. When nose 233 reaches the notch, it will snap in place, the notch being located at the low end of take up arm 234 arc. The take up arm on its up swing will now carry slide 234 with it. The connection will hold until the next index.

Without further elaboration the foregoing will so fully illustrate my invention that others may, by applying current or future knowledge, readily adapt the same for use under various conditions of service.

What is claimed as the invention is:

1. An automatic thread changer for use in connection with a sewing machine having a needle bar assembly, said automatic thread changer comprising a plurality of threaded needles and means to move said threaded needles one by one sequentially into operative but detachable connection with said needle bar assembly to form a temporary solid needle bar assembly, said automatic thread changer further including a plurality of needle holders to which said threaded needles are secured, one threaded needle being secured to one particular needle holder, said needle holders being detachably secured, one by one to a slidable connector, said needle holders having a through opening and said connector having a through opening whereby when there is a solid needle bar assembly, one of said needle holder through openings is aligned with said connector opening and a releasable shot pin extending through said openings to form said solid needle bar assembly.

2. The invention of claim 1 wherein needle holders not in use are held on a ring support.

3. The invention of claim 1 including cam means to raise and lower a pivot ring to free a needle holder from said shot pin.

4. The invention of claim 3 wherein said shot pin is spring biased.

5. The invention of claim 4 including an oscillating arm that is turned a finite amount per index to disengage said needle holder from said connector and be slid onto said ring support.

6. The invention of claim 5 wherein said arm is turned 30% per index.

7. The invention of claim 1 wherein said needle holders interfit in a locking arrangement with said connector which is a part of a guided needle bar assembly.

8. The invention of claim 7 wherein said needle holders have a male "T" projection with a tapered hole and said connector has a female "T" opening.

9. The invention of claim 1 wherein said automatic thread changer is an integral part of said sewing machine.

* * * * *